US012098561B2

(12) United States Patent
Barlow et al.

(10) Patent No.: US 12,098,561 B2
(45) Date of Patent: Sep. 24, 2024

(54) TEMPORARY BRACE SYSTEM FOR A STRUCTURE

(71) Applicant: Innovatech, LLC, Kanarraville, UT (US)

(72) Inventors: James Barlow, Colorado City, AZ (US); James Harker, Colorado City, AZ (US)

(73) Assignee: Innovatech Systems, LLC, Kanarraville, UT (US)

( * ) Notice: Subject to any disclaimer, the term of this patent is extended or adjusted under 35 U.S.C. 154(b) by 483 days.

(21) Appl. No.: 17/179,598

(22) Filed: Feb. 19, 2021

(65) Prior Publication Data

US 2022/0127867 A1 Apr. 28, 2022

Related U.S. Application Data

(60) Provisional application No. 63/106,656, filed on Oct. 28, 2020.

(51) Int. Cl.
*E04G 25/04* (2006.01)
*E04G 21/26* (2006.01)
*E04G 25/00* (2006.01)

(52) U.S. Cl.
CPC ..... *E04G 25/04* (2013.01); *E04G 21/26* (2013.01); *E04G 2025/003* (2013.01)

(58) Field of Classification Search
CPC ..... E04G 21/26; E04G 23/04; E04G 17/14; E04G 25/04; E04G 2025/003; E04H 9/0237; E04H 9/021; E04H 9/028; E04H 9/024; E04H 12/20; E04H 12/16
USPC ..... 52/148
See application file for complete search history.

(56) References Cited

U.S. PATENT DOCUMENTS 708,277 A * 9/1902 Warner ..... H02G 7/20 174/45 R
2,581,351 A * 1/1952 Black ..... E04H 12/16 52/745.17
2,584,713 A * 2/1952 Kanaval ..... G09F 7/18 40/607.04

(Continued)

FOREIGN PATENT DOCUMENTS

CA 2718798 A1 * 4/2011 ..... E04G 25/04
CN 102086704 A * 6/2011 ..... E04G 25/04

(Continued)

*Primary Examiner* — Taylor Morris
(74) *Attorney, Agent, or Firm* — Gurr Brande & Spendlove, PLLC; Robert A. Gurr

(57) ABSTRACT

A temporary brace system includes a temporary brace having a top portion coupleable to a building structure, a bottom portion that contacts the ground, and a middle portion interposed between the top and the bottom portions. The top portion has an adapter capable of receiving numerous attachment brackets so as to be coupleable to any building structure. The middle portion of the temporary brace includes cable struts that may be hingedly coupled to a first and a second support at a first end and may receive support cables. The middle portion may further include hoisting brackets to allow a connection point for hoisting and transporting the temporary brace system. The bottom portion may have a bolt coupler and an adjustment unit. The adjustment unit allows the first and the second support to be extended or shortened via a telescoping bracket.

6 Claims, 14 Drawing Sheets

(56) References Cited

U.S. PATENT DOCUMENTS 2,705,061 A * 3/1955 Getz ..... E04H 12/16 52/114
2,736,398 A * 2/1956 Peterson ..... E04H 12/20 174/79
3,110,368 A * 11/1963 Ross ..... H01Q 1/1242 52/223.4
3,229,950 A * 1/1966 Macrobbie ..... E04G 21/26 248/354.5
3,574,981 A * 4/1971 Henschen ..... E04G 21/26 248/354.3
3,833,193 A 9/1974 Benz
4,000,592 A * 1/1977 Kelly ..... E04G 21/26 52/149
4,068,427 A * 1/1978 Camardo ..... E04G 21/26 52/749.1
4,070,833 A * 1/1978 Hancock ..... E04G 21/26 52/149
4,079,556 A * 3/1978 Luck ..... E04G 21/26 52/749.1
4,212,015 A * 7/1980 Graf ..... H01Q 1/1235 343/901
4,757,975 A * 7/1988 Gordon ..... E04G 21/16 254/133 A
4,800,690 A * 1/1989 Bunce ..... E04H 12/20 52/146
4,872,634 A * 10/1989 Gillaspy ..... E04G 21/26 248/354.3
4,899,500 A * 2/1990 Miller ..... E04H 12/10 52/146
5,832,688 A * 11/1998 Crissey ..... E04H 12/10 52/651.07
5,915,671 A * 6/1999 Bott ..... E04G 21/16 269/287
5,956,906 A * 9/1999 Berich ..... E04G 21/26 52/745.11
6,226,935 B1 * 5/2001 Kuramochi ..... E04H 9/0237 52/167.3
6,412,649 B1 * 7/2002 Khachaturian ..... B66C 1/12 212/242
6,438,905 B2 * 8/2002 Constantinou ..... E04H 9/0235 52/167.3
6,854,222 B2 * 2/2005 Hansort ..... E04G 21/26 403/258
7,665,252 B2 2/2010 Lang
8,418,997 B2 * 4/2013 Bastone ..... E04G 25/04 52/126.6
8,763,320 B1 * 7/2014 Chou ..... E04H 12/16 52/167.3
8,919,051 B1 12/2014 Echemendia
9,109,892 B2 * 8/2015 Carbajal ..... G01C 15/10
9,593,505 B2 * 3/2017 Pryor ..... E04B 1/24
10,024,491 B2 * 7/2018 Knickrehm ..... E04C 3/02
10,125,608 B2 * 11/2018 Moye ..... E04G 23/04
10,563,418 B2 * 2/2020 Pall ..... E04H 9/024
10,858,827 B2 * 12/2020 Hou ..... E04B 1/98
11,359,399 B2 * 6/2022 Reyes ..... H01Q 1/246
2002/0050422 A1 * 5/2002 Wymann ..... E04G 1/20 182/82
2008/0016794 A1 * 1/2008 Tremblay ..... E04H 9/0237 52/167.4
2008/0056853 A1 * 3/2008 Willis ..... E04G 23/02 414/11
2009/0101774 A1 * 4/2009 Shih ..... E04G 25/065 248/200.1
2013/0146825 A1 * 6/2013 Buckingham ..... B66F 3/00 254/105
2014/0237914 A1 * 8/2014 Brandao ..... E04H 12/16 52/223.13
2017/0370520 A1 * 12/2017 Knickrehm ..... F16M 13/022
2019/0234038 A1 * 8/2019 Wood ..... E04G 25/04
2020/0018059 A1 1/2020 Barlow et al.

FOREIGN PATENT DOCUMENTS

CN 111321846 A 6/2020
CN 117005706 A * 11/2023 ..... E04G 21/1841
GB 2302701 A * 1/1997 ..... E04G 21/26
KR 20070043743 A * 4/2007 ..... E04G 25/06
KR 100749048 B1 * 8/2007 ..... E04G 25/04
KR 20090059906 A * 6/2009 ..... E04G 25/065
NL 7905429 A * 1/1981 ..... E04G 11/12
WO WO-8302794 A1 * 8/1883 ..... E04G 17/14

* cited by examiner

TEMPORARY BRACE SYSTEM FOR A STRUCTURE

CROSS-REFERENCE TO RELATED APPLICATIONS

This application claims the benefit of U.S. Provisional Application Ser. No. 63/106,656, filed on Oct. 28, 2020, which is incorporated herein by reference.

TECHNICAL FIELD

The present disclosure relates to temporary construction braces. More particularly, the present disclosure relates to a brace that is easily transported and adjustable so as to be adapted to numerous construction projects.

BACKGROUND

Temporary bracing has been used to sturdy or level a variety of walls during a construction task. For example, temporary bracing has been used to secure cement, wood, and steel walls during the construction process. Without temporary bracing, walls may not be able to withstand even minor wind loads. Further, temporary bracing allows walls to be properly leveled. Temporary bracing is also employed to hold a building in place prior to placing the roof and any other connections that will permanently secure the building in place.

However, with the many benefits of temporary bracing, some of the braces on the market are difficult to use and may not provide the security that is needed. For example, many wood braces have been used in building homes, which may have inherent weak points that may not withstand any wind load or other natural forces. On the other hand, temporary steel bracing may not be easily transported or adjusted to a given construction task, thereby delaying construction and creating frustration for construction workers. Further, many temporary braces have a single base which contacts the ground even though there may be numerous ground foundations or sites that would require a different base. Without secure ground contact, the temporary brace may be prone to slippage, creating an unsafe environment for construction workers.

Accordingly, there is a need for a brace system that has structural integrity, is adjustable to various constructions tasks, heights, and ground surfaces, and is easily transported. The present invention seeks to solve these and other problems.

SUMMARY OF EXAMPLE EMBODIMENTS

In one embodiment, a temporary brace system comprises a temporary brace having a top portion coupleable to a building structure, a bottom portion that contacts the ground, and a middle portion interposed between the top and the bottom portions. The top portion comprises an adapter capable of receiving numerous attachment brackets so as to be coupleable to the building structure. The top portion further comprises top cable coupling sites. The middle portion of the temporary brace comprises first and second cable struts that may be hingedly coupled to a first and a second support at a first end of the first and second cable struts. The first and second cable struts may receive support cables at a second end, opposite the first end, that may extend to the top cable coupling sites and bottom cable coupling sites. The first cable struts may be coupled to each other and the second cable struts may be coupled to each other via strut cables, which provide strength therebetween. The middle portion may further comprise hoisting brackets to allow a connection point for hoisting and transporting the temporary brace system. The bottom portion may comprise the bottom cable coupling sites, a bolt coupler, and an adjustment unit. In some embodiments, the bolt coupler may couple to a single ground bracket with a single leg or, alternatively, a single ground bracket with a plurality of legs to provide stability on numerous surfaces. The adjustment unit allows the first and the second support to be extended or shortened via a telescoping bracket. In one embodiment, the telescoping bracket may be adjusted about two feet, although other lengths are possible. Once the temporary brace system is in the desired location, a washer set may secure the system.

In one embodiment, the temporary brace system comprises a hydraulic-powered adjuster that attaches to handling equipment, such as a telehandler forklift or other similar machinery, coupleable to the adjustment unit for setting the plumbing (i.e., leveling) of each wall.

DETAILED DESCRIPTION OF EXAMPLE EMBODIMENTS

Figure 1:
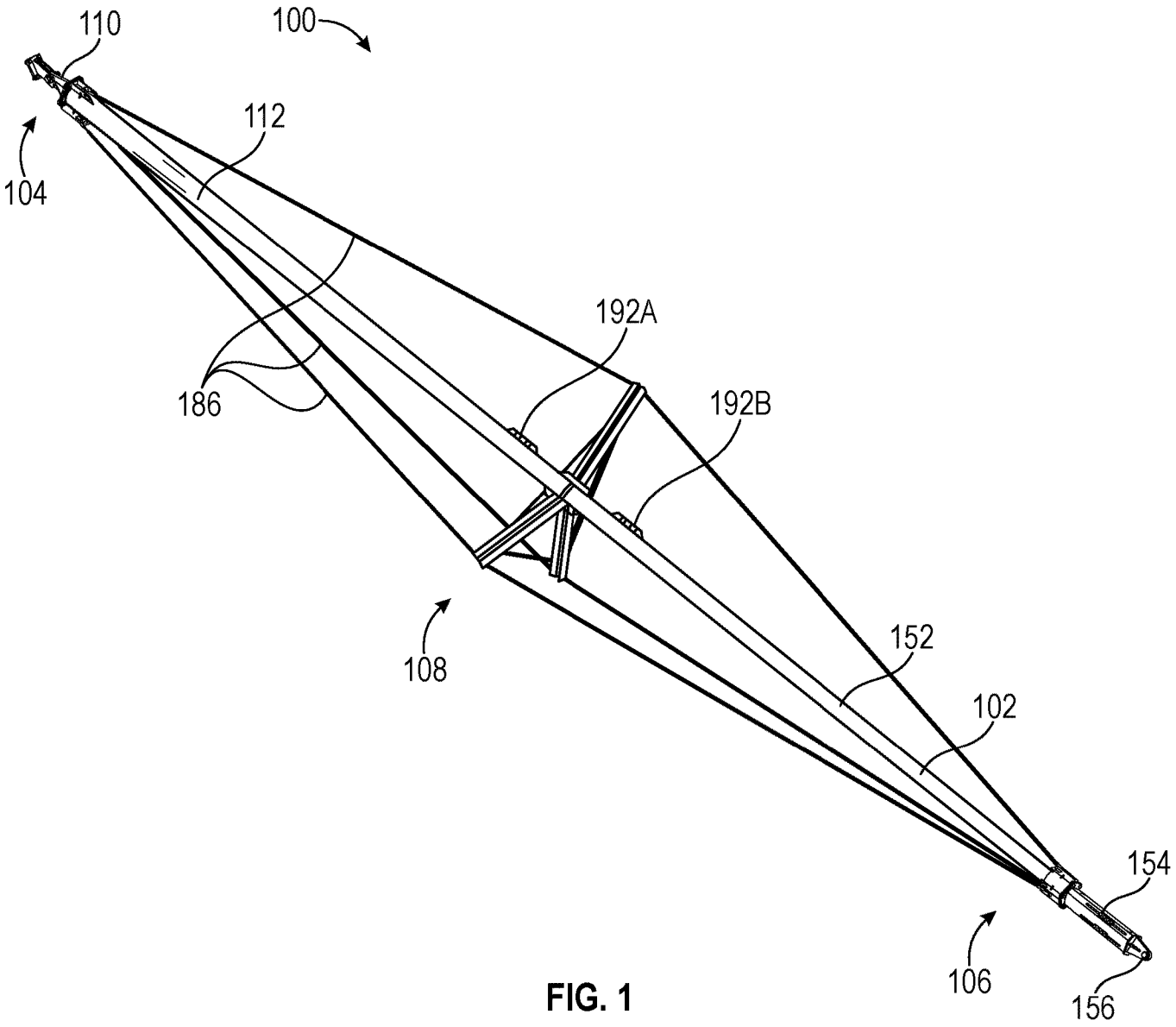
FIG. 1 illustrates a side perspective view of a temporary brace of a temporary brace system.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously described, there is a need for a brace system that has structural integrity, is adjustable to various constructions tasks, heights, and ground surfaces, and is easily transported. The temporary bracing system disclosed herein seeks to solve these and other problems.

Temporary bracing allows construction workers to maintain placement of walls, provide safety for construction sites, and level the walls prior to securing them. However, some braces on the market are difficult to transport and position. Further, many of the temporary braces on the market fail to adapt to particular ground surfaces. For example, many temporary braces may work on cement surfaces, but fail to provide proper support on a gravel surfaces, thereby causing a user to either take additional risks in the construction process or purchase other braces.

In contrast, the temporary brace system described herein comprises a first support with an adapter and a second support with a bolt coupler. The adapter and the bolt coupler may receive various attachments that may conform to a given building structure and ground surface. It will be appreciated that the temporary brace system is highly adjustable as well as easily transported. For example, the temporary brace comprises hoisting brackets, providing a connection point for lifting and transporting the temporary brace. The temporary brace further comprises cable struts that are hingedly coupled to a first support and a second support that may be folded against the first and second supports so as to be transportable. The temporary bracing system may be placed in any environment to provide stability against loads that the building will be subjected to during the period in which the building could not otherwise stand on its own; for example, wind loads and other natural forces.

Figure 2:
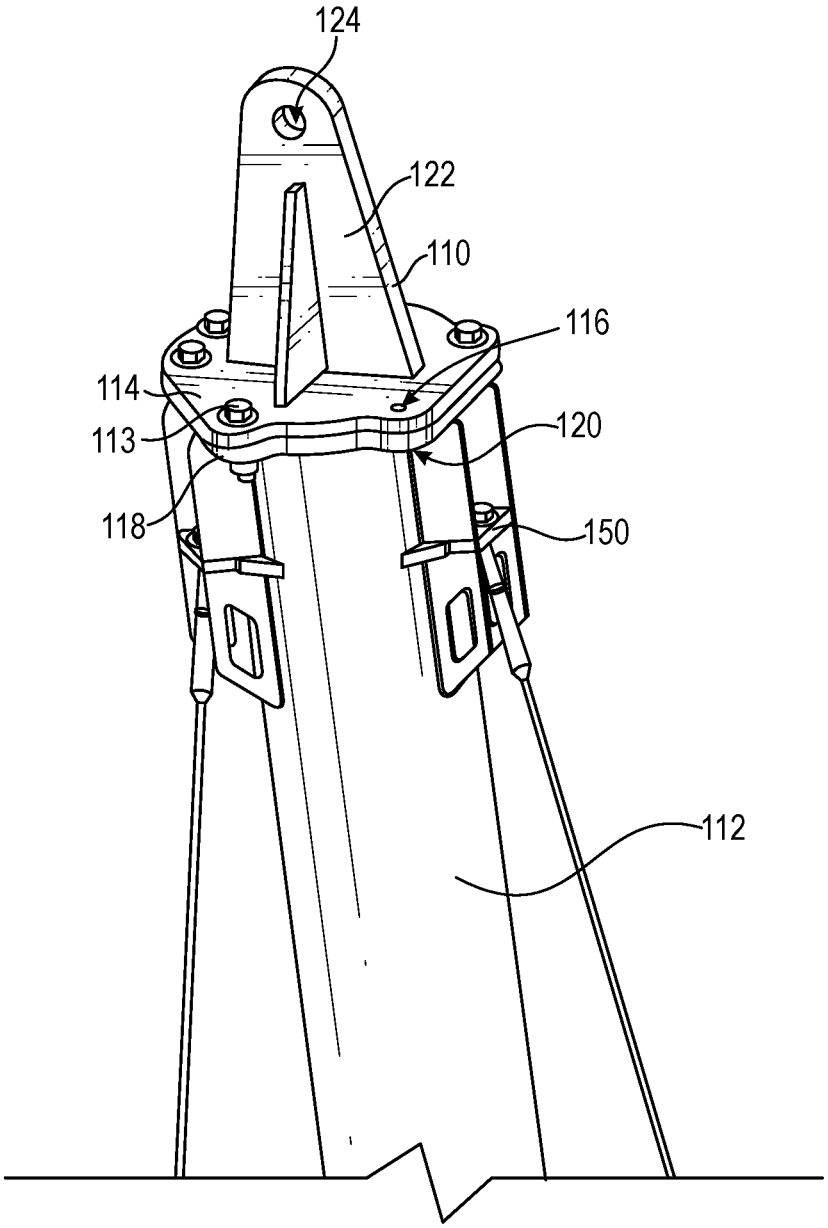
FIG. 2 illustrates a top perspective view of an adapter coupled to a first support of a temporary brace system.

As shown in FIGS. 1-2, in one embodiment, a temporary brace system 100 comprises a temporary brace 102 having a top portion 104 coupleable to a building structure, a bottom portion 106 that contacts the ground, and a middle portion 108 interposed between the top and the bottom portions 104, 106. The top portion 104 comprises an adapter 110 capable of receiving numerous attachment brackets so as to be coupleable to any building structure. The adapter 110 may be coupled to a first support 112 via, for example, nuts and bolts. It will be appreciated that, in some embodiments, the adapter 110 may be welded to the first support 112 or may be molded or part of the first support 112 to create a single unit. Referring to FIG. 2, the adapter 110 may comprise an adapter base 114 having adapter apertures 116. The adapter apertures 116 may align with a top base portion 118 and top portion apertures 120 so that the adapter 110 may be coupled to the first support 112 via the bolts 113. The adapter 110 may further comprise a protrusion 122 with a bracket aperture 124, where various adapter brackets may be removeably attachable thereon. For example, in one embodiment, the numerous brackets may comprise a single fixed bracket 126 (FIG. 3) or a dual fixed bracket 128 (FIG. 4) that may be coupleable to multiple adapters. In addition, the top portion 104 further comprises top cable coupling sites 150.

Figure 3:
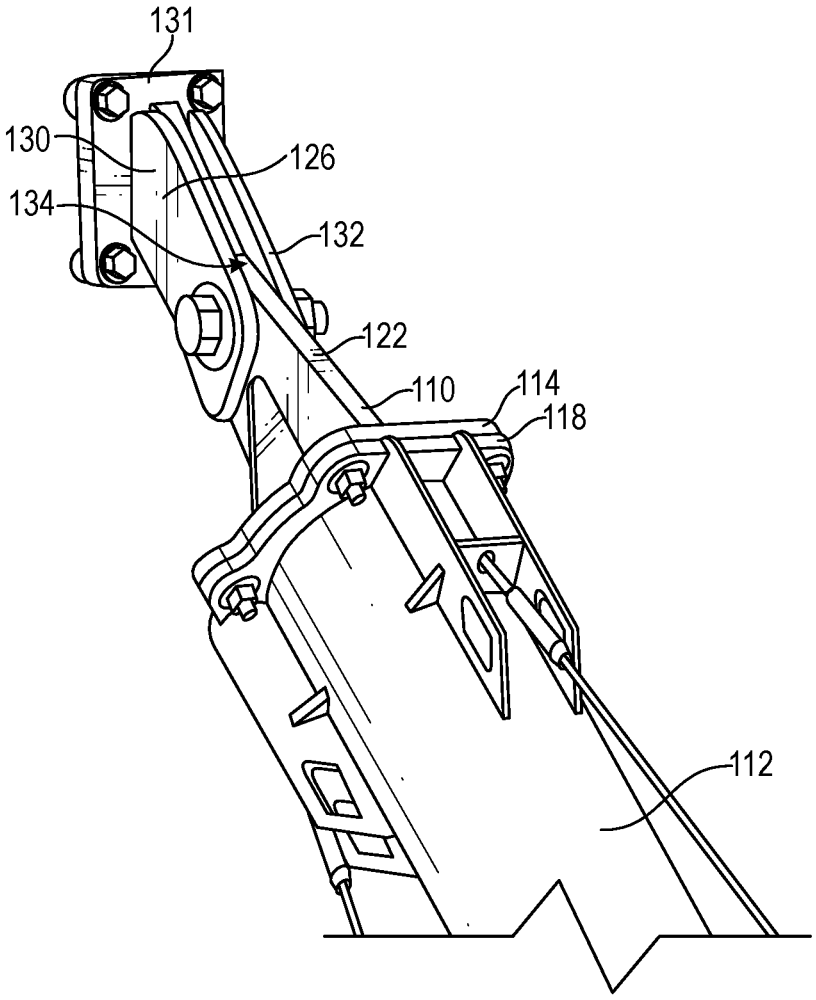
FIG. 3 illustrates a side perspective view of a single bracket and an adapter coupled to a first support of a temporary brace system.

Referring to FIG. 3, the single fixed bracket 126 comprises a first single bracket arm 130 and a second single bracket arm 132 with a first single bracket channel 134 interposed therebetween to receive the protrusion 122 with the bracket aperture 124. The single fixed bracket 126 further comprises a single bracket base 131 to couple to a building structure.

Figure 4:
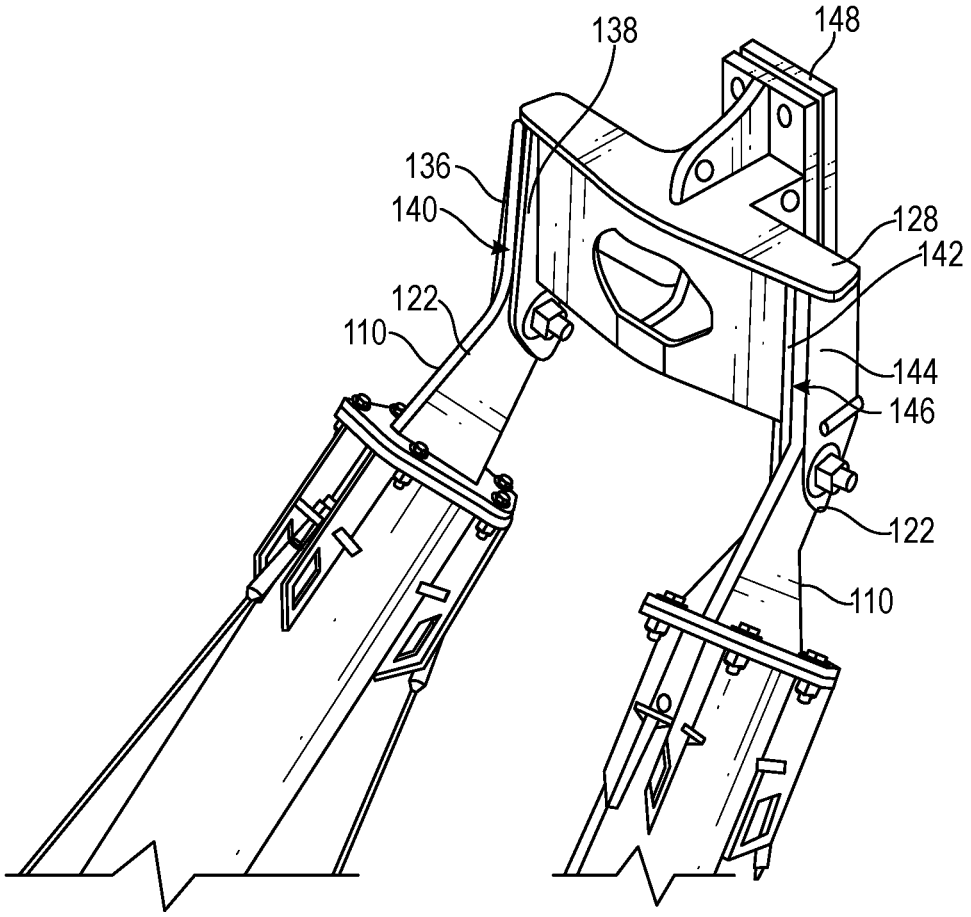
FIG. 4 illustrates a top perspective view of a dual bracket coupled to multiple adapters of a temporary brace system.
Figure 5:
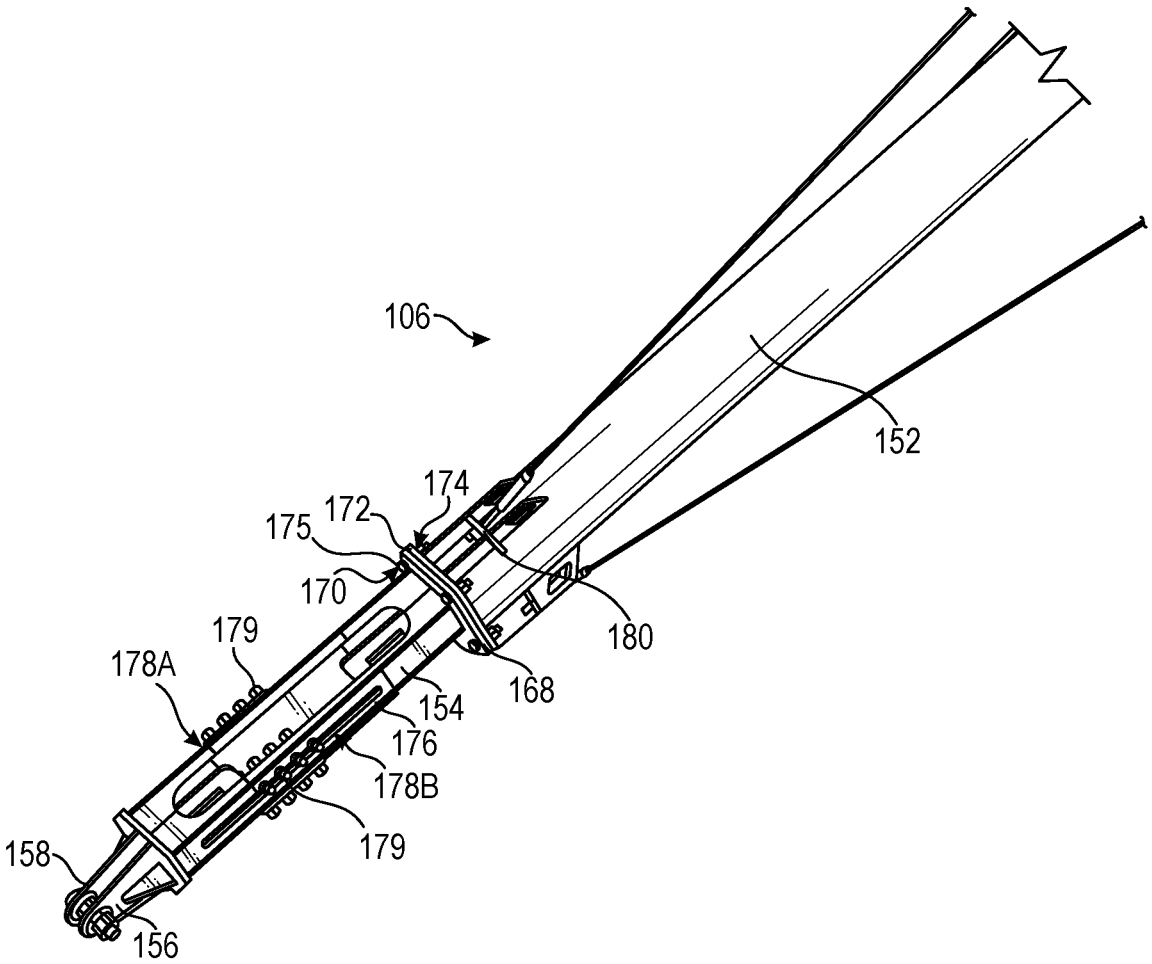
FIG. 5 illustrates a side perspective view of an adjustment unit and bolt coupler coupled to a second support of a temporary brace system.

Referring to FIG. 4, the dual fixed bracket 128 may comprise a first dual bracket arm 136 and a second dual bracket arm 138 with a first channel 140 therebetween, and a third dual bracket arm 142 and a fourth dual bracket arm 144 with a second channel 146 therebetween. The dual fixed bracket 128 may also comprise a dual bracket base 148 that may be coupled to a building structure.

Figure 6:
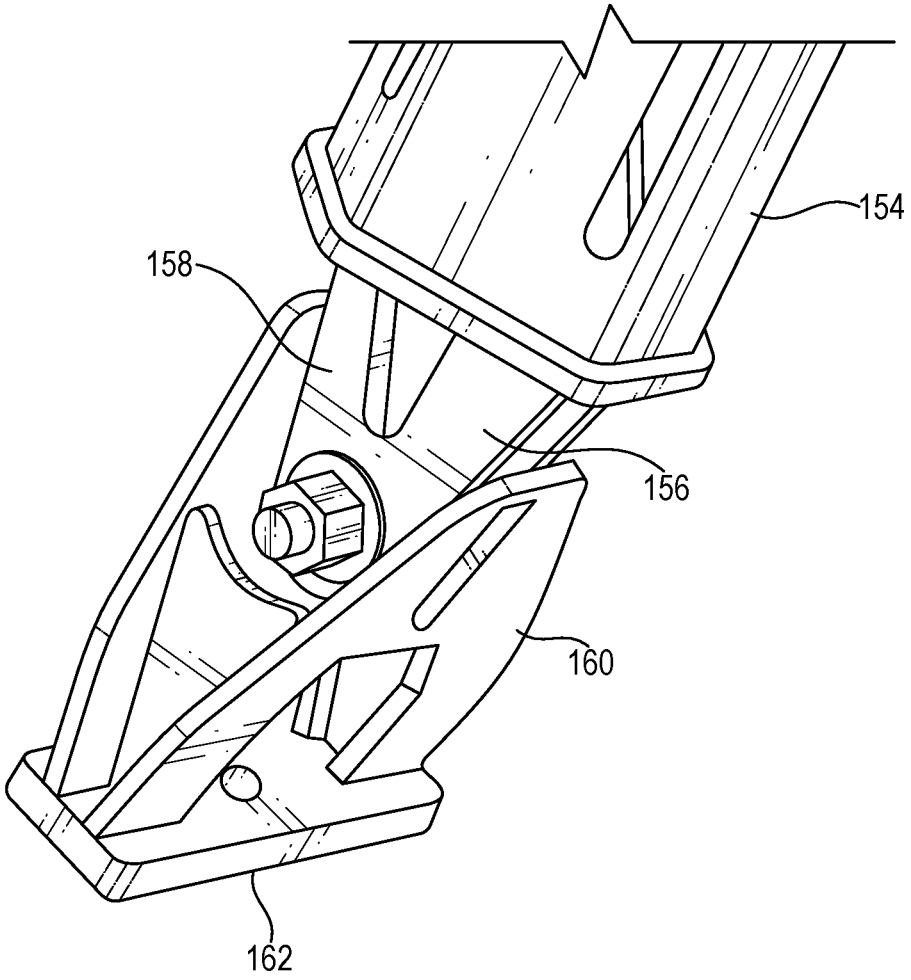
FIG. 6 illustrates a perspective view of a ground bracket with a single leg coupled to a bolt coupler of a temporary brace system.
Figure 7:
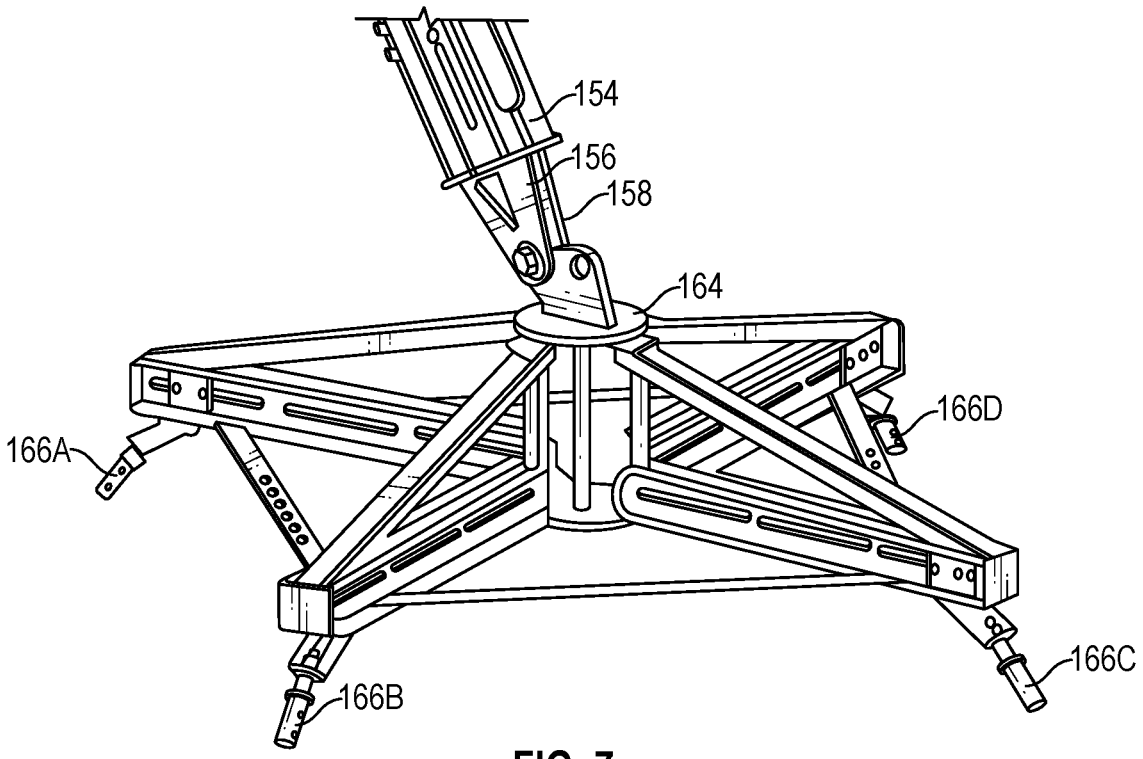
FIG. 7 illustrates a side perspective view of a ground bracket with a plurality of legs coupled to a bolt coupler of a temporary brace system.
Figure 8:
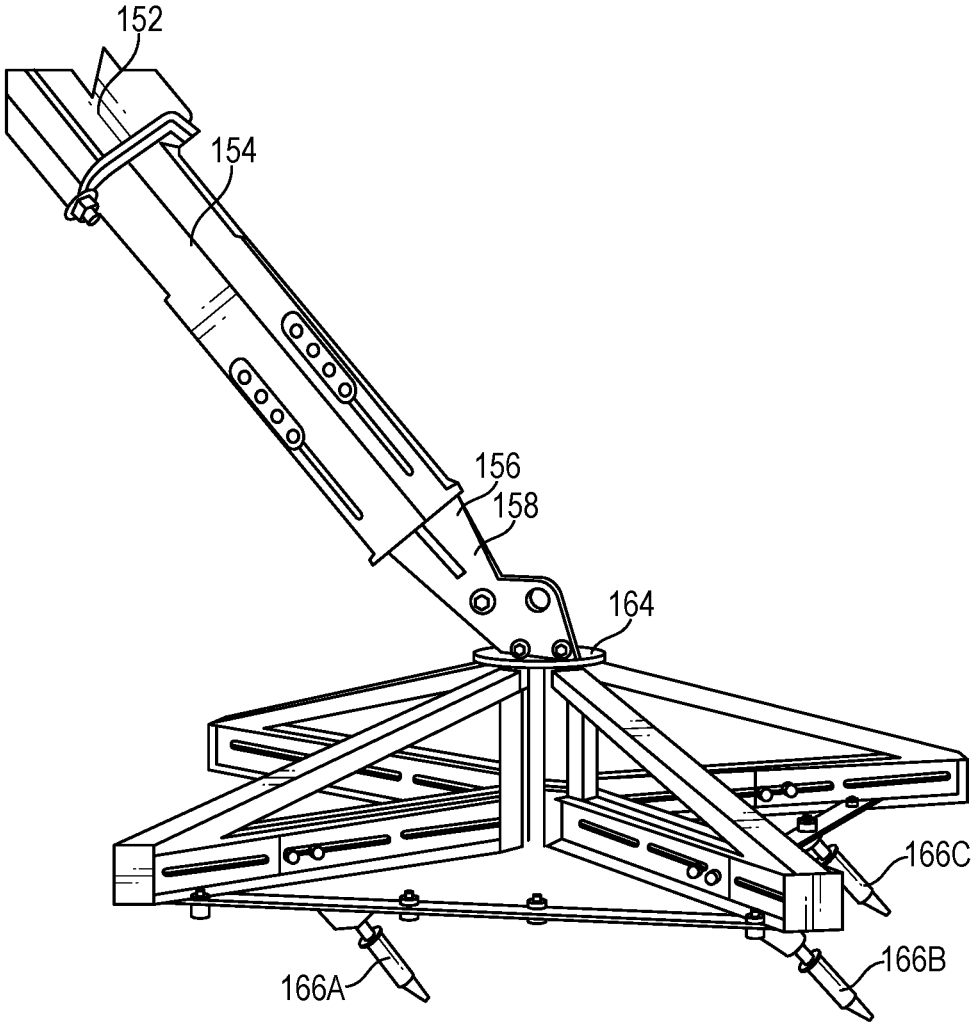
FIG. 8 illustrates a side perspective view of a ground bracket with a plurality of legs coupled to a bolt coupler of a temporary brace system.
Figure 9:
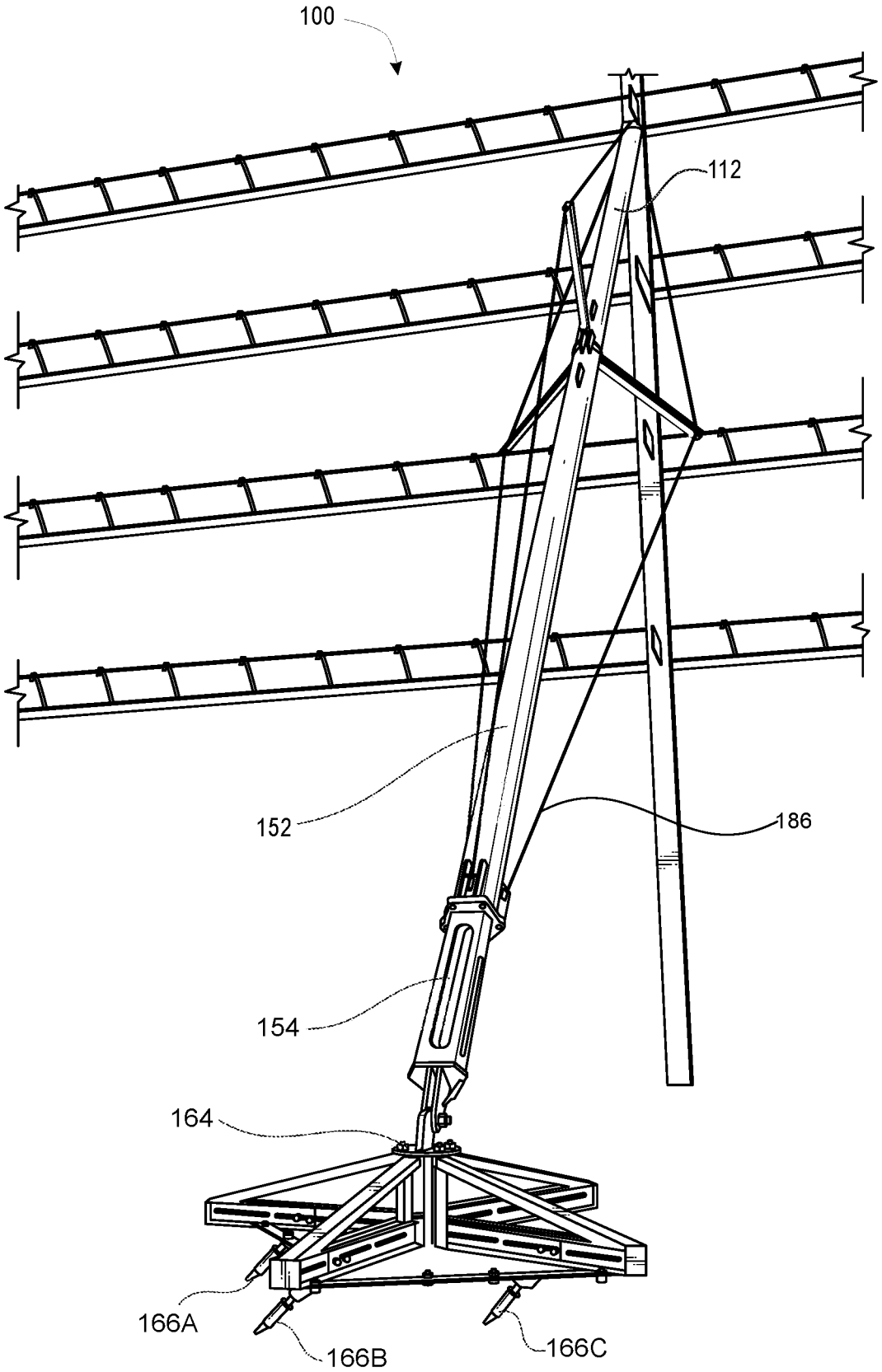
FIG. 9 illustrates a perspective view of a temporary brace, with a ground bracket, coupled to a structure.
Figure 10:
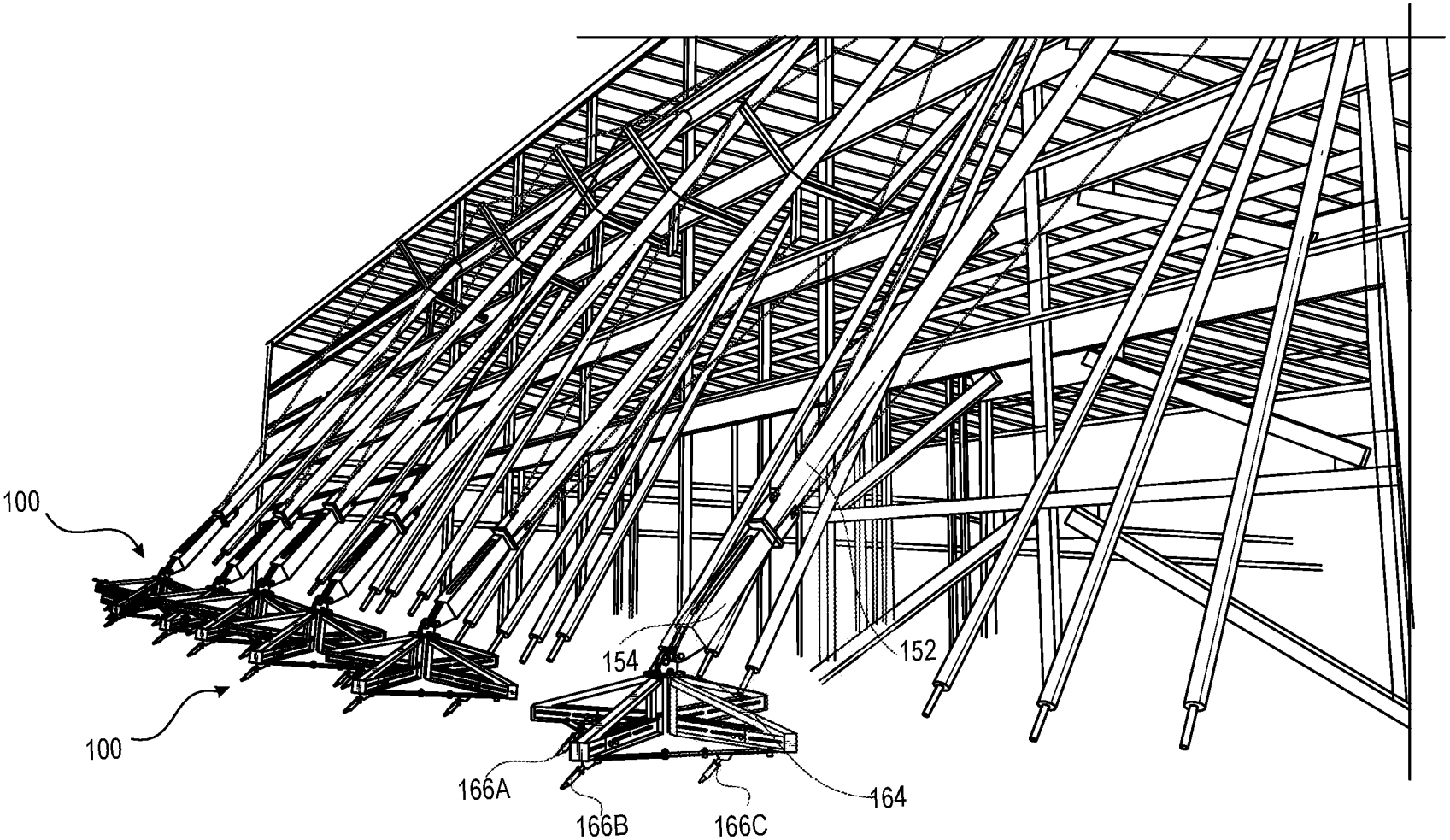
FIG. 10 illustrates a perspective view of a plurality of temporary braces, with ground brackets, coupled to a structure.

The bottom portion 106, as shown in FIG. 5-8, may comprise a second support 152 with an adjustment unit 154 and bolt coupler 156 attached thereto. The bolt coupler 156 may comprise a bolt protrusion 158 that may receive various ground brackets. Referring to FIG. 6, in some embodiments, the bolt coupler 156 may couple to a ground bracket 160 with a single leg 162 (e.g., a single micropile). Alternatively, as illustrated in FIGS. 7-10, the bolt coupler 156 may couple to a ground bracket 164 with a plurality of legs 166A-166D (e.g., a multiple micropile) to provide stability on numerous surfaces. For example, as shown in FIG. 9, the ground bracket 164 with the plurality of legs 166A-166D may be used to stabilize a building structure. Additionally, as shown in FIG. 10, many temporary brace systems 100, each having ground brackets 164 with a plurality of legs 166A-166D, may be used on numerous temporary braces to support a whole building during the construction process. In particular, as best seen in FIG. 9, the ground brackets 164 may be positioned on the ground and coupled to the second support 152. The first support 112 may then couple to the building, thereby providing stability and leveling capabilities.

Referring back to FIG. 5, the adjustment unit 154 may comprise an adjustment base 168 that may couple to the second support 152. In particular, the adjustment unit 154 may comprise adjustment apertures 170 on the adjustment base 168, and the bottom portion 106 may comprise a bottom portion base 172 with bottom portion apertures 174. Accordingly, the adjustment apertures 170 may align with the bottom portion apertures 174 so that the adjustment unit 154 may be coupled to the second support 152 using bolts 175 or other securement mechanism. The adjustment unit 154 allows the overall height of the first and the second support 112, 152 to be extended or shortened via a telescoping bracket 176. Specifically, the telescoping bracket 176 comprises slidable channels 178A, 178B with bolts 179 or other securement mechanisms therein, allowing the telescoping bracket 176 to slide on the adjustment unit 154, thereby extending or shortening the overall height of the temporary brace system 100 (e.g., the height of the first and second supports 112, 152). In one embodiment, the telescoping bracket 176 may be adjusted by two feet, although other lengths may be used. Once the desired height is reached, the bolts 179 are tightened. While bolts are used as an example, it will be appreciated that other securement mechanisms may be used, such as a plurality of apertures and cotter pins, spring-loaded pins, or other means. Further, the bottom portion may comprise bottom cable coupling sites 180.

Figure 11:
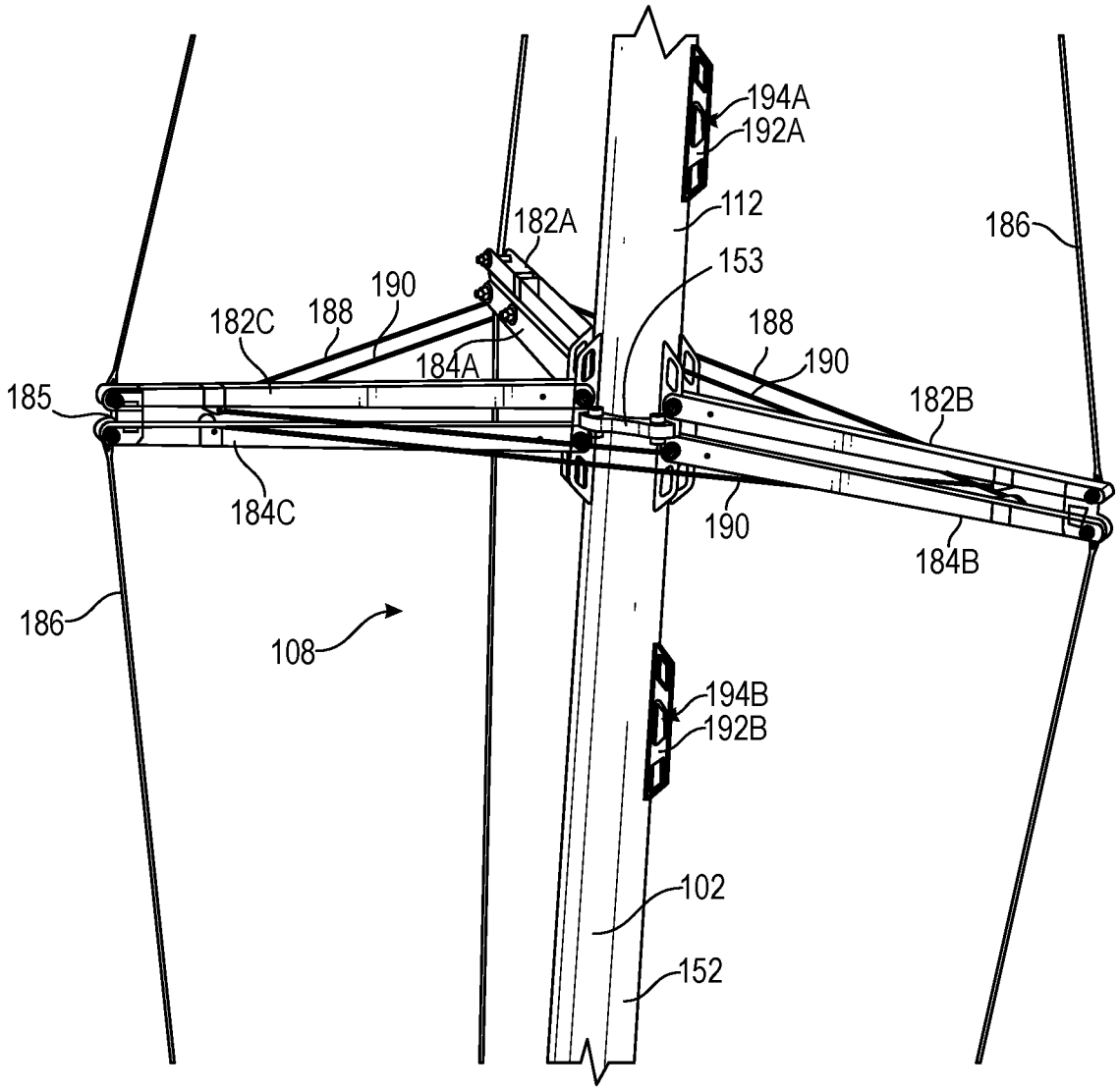
FIG. 11 illustrates a side perspective view of first and second cable struts of a temporary brace system.

As illustrated in FIG. 11, the middle portion 108 of the temporary brace 102 comprises the first support 112 and a second support 152, which may be coupleable via nuts and bolts, welding, or any other securing mechanism. The first and second supports 112, 152 may be cylindrical and hollow or solid. Alternatively, the first and second supports 112, 152 may be triangular, quadrangular, or any other shape. In one embodiment, the first and second supports 112, 152 are made of steel. While the first and second supports 112, 152 are shown, it will be appreciated that there may be one or more supports. For example, in some embodiments, the temporary brace 102 comprises one support. Alternatively, in some embodiments, the temporary brace 102 may comprise three or more supports.

Additionally, first cable struts 182A-182C may be hingedly coupled to the first support 112 and second cable struts 184A-184C may be hingedly coupled to the second support 154 in a location where the first and second supports 112, 152 are coupled together. It will be appreciated that the temporary brace 102 may, in one embodiment, lack cable struts and rely on the structural integrity of the support. When the first cable struts 182A-182C and second cable struts 184A-184C on the first and second supports 112, 152, respectively, are in a folded position, the temporary brace 102 may be easily transported. On the other hand, when the first cable struts 182A-182C and second cable struts 184A-184C are in an extended position they may contact or approximate one another and be coupled together via strut bracket 185.

The first cable struts 182A-182C and second cable struts 184A-184C may then each receive a support cable 186 at the end with the strut bracket 185. The support cables 186 may extend from the first cable struts 182A-182C to the top cable coupling sites 150, and may extend from second cable struts 184A-184C to the bottom cable coupling sites 180. The support cables 186 may be steel cables that are pre-tensioned to add rigidity to the first and second supports 112, 152. The first cable struts 182A-182C may be coupled to each other via first strut cables 188 and the second cable struts 184A-184C may be coupled to each other via second strut cables 190, thereby providing strength therebetween. Due to the cable struts 182A-182C, 184A-184C, the strut cables 188, 190, and the support cables 186, the joint between the first and second support 112, 152 is secured and prevents bending, twisting, or other unwanted movement. By coupling a first support 112 to a second support 152 via coupling bracket 153 and their associated strut assemblies (e.g., cable struts 182A-182C, strut cables 188, support cable 186), the overall length, and therefore height, of the temporary support brace system 100 may be significantly more than the temporary braces in the art, which only have one support beam.

The middle portion 108 may further comprise hoisting brackets 192A, 192B to allow a connection point for hoisting and transporting the temporary brace system 100. The hoisting brackets 192A, 192B may be coupled to the first and second support 112, 152, respectively. Further, the hoisting brackets 192A, 192B may comprise connection apertures 194A, 194B to allow machinery to be coupled thereto so as to transport the temporary brace 102.

Figure 12:
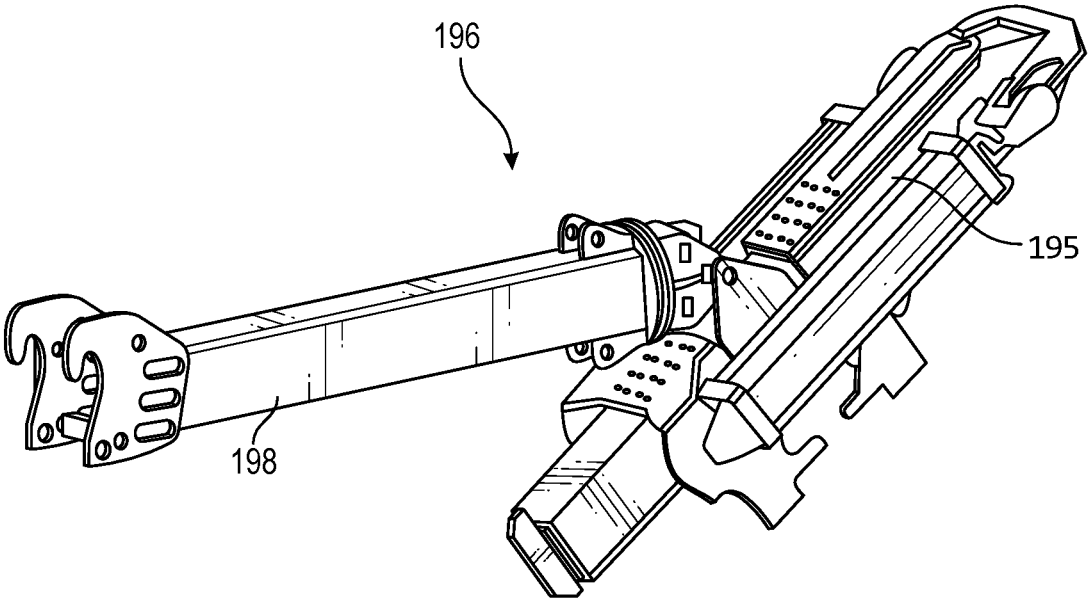
FIG. 12 illustrates a side perspective view of a hydraulic-powered adjuster of a temporary brace system.
Figure 13:
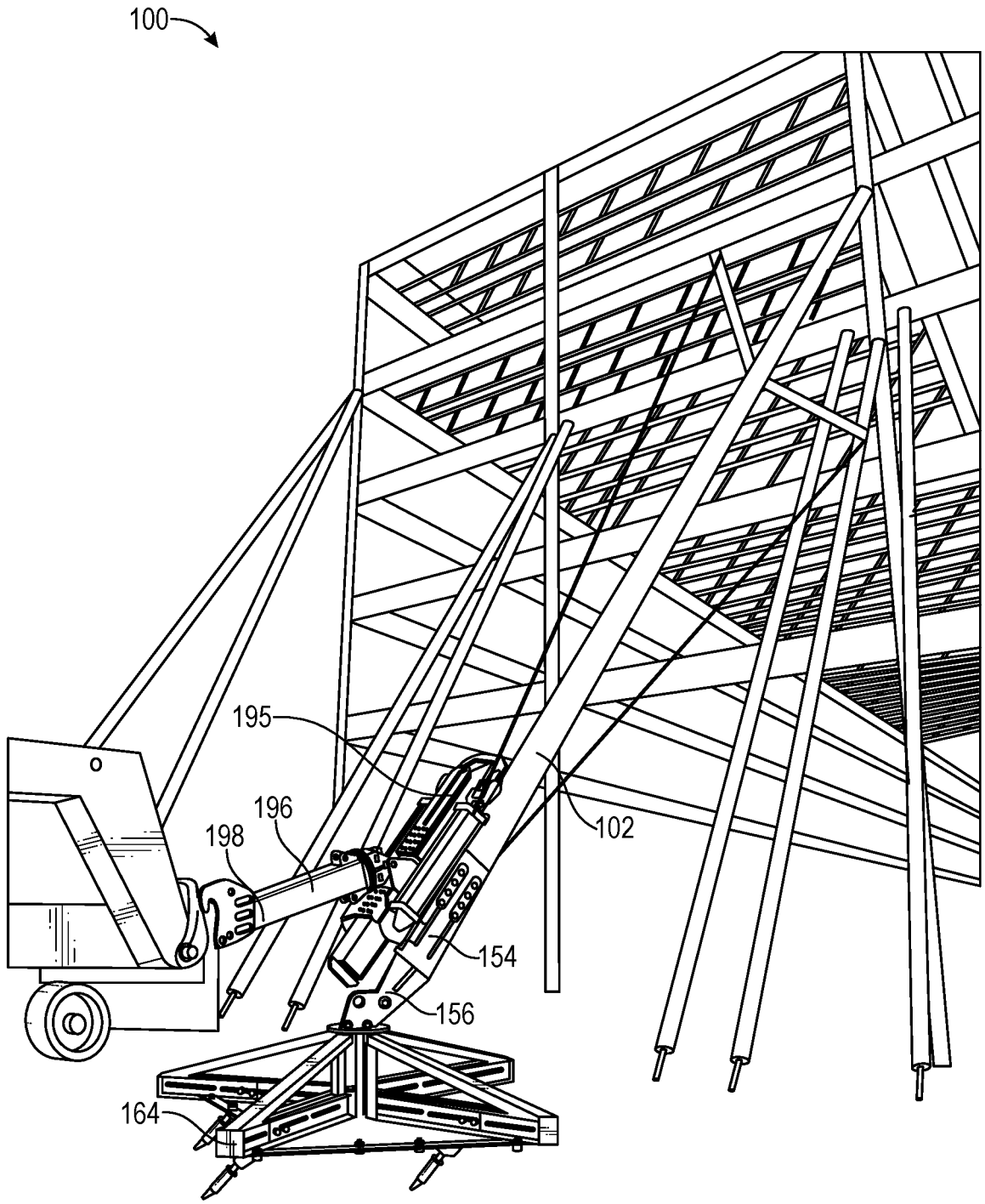
FIG. 13 illustrates a side perspective view of a hydraulic-powered adjuster coupled to an adjustment unit of temporary brace system.
Figure 14:
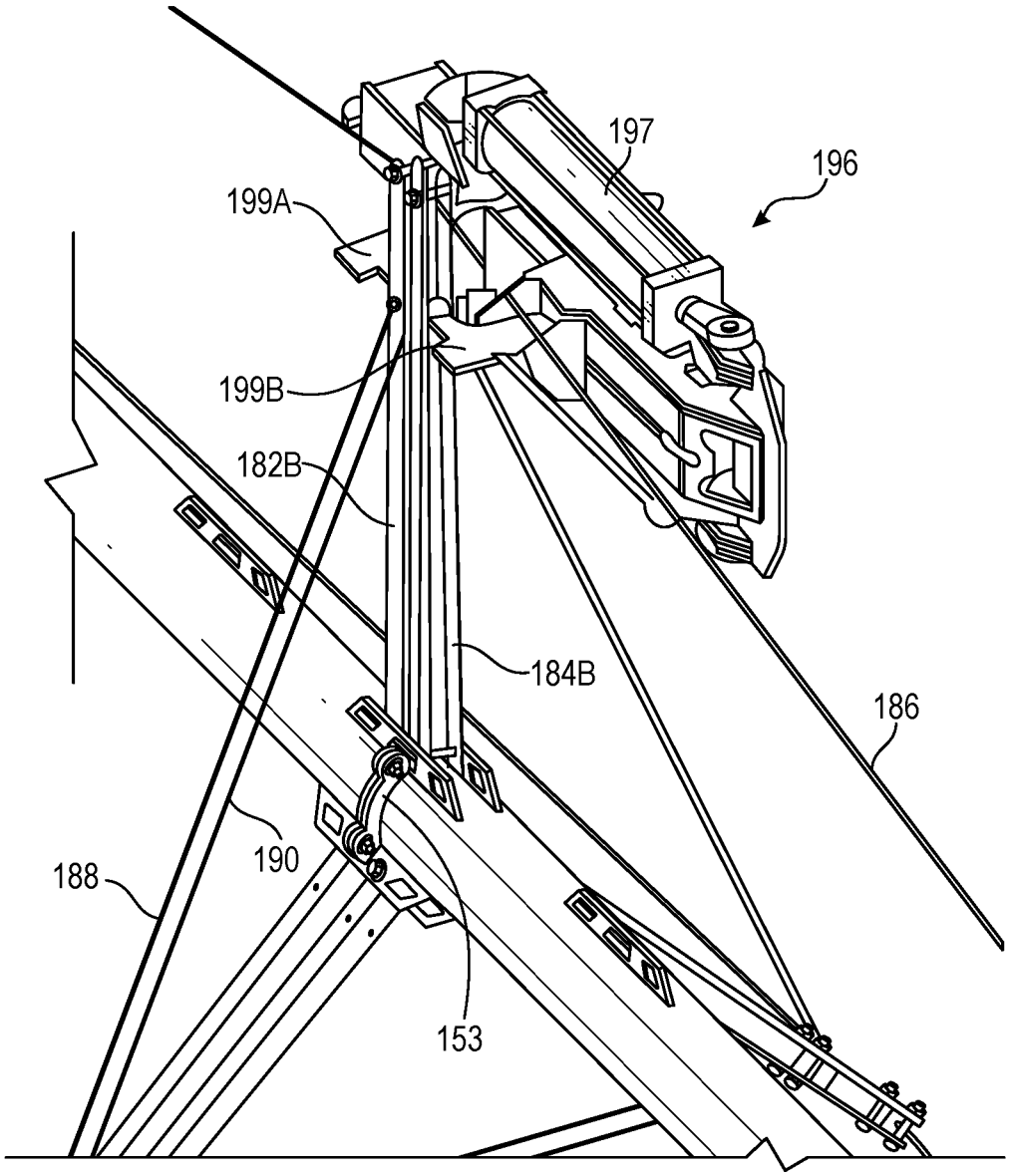
FIG. 14 illustrates a rear perspective view of a hydraulic-powered adjuster coupled to a first and a second strut.

In one embodiment, shown in FIGS. 12-13, the temporary brace system 100 comprises a hydraulic-powered adjuster 196 that attaches to handling equipment (e.g., a telehandler forklift or other similar machinery) coupleable to the adjustment unit 154 for setting the plumbing (i.e., leveling) of each wall. The hydraulic-powered adjuster may comprise an adjustment unit coupler 195 and an attachment arm 198 to couple to heavy machinery (e.g., skid-steer). The hydraulic-powered adjuster 196 may extend or retract the telescoping bracket 176, adjusting the overall height and position of the temporary brace system 100 and leveling the attached wall. As shown in FIG. 14, in one embodiment, the hydraulic-powered adjuster 196 may be used to overcome the tension in cables 186 so as to couple or decouple the first cable struts 182A-182C to the second cable struts 184A-184C. For example, the hydraulic-powered adjuster 196 may utilize a hydraulic piston 197 and may further comprise a first panel 199A and a second panel 199B that, when coupled to the first and second cable struts, squeezes or decreases the distance between the first and second cable struts so as to be coupled together or decoupled (e.g., strut brackets 185 may be removed).

To use the temporary brace system 100, a user may transport the temporary brace system 100 by collapsing the first and second cable struts 182A-182C, 184A-184C. The user may then attach a telescopic handler, skid-steer, or other machine to the hoisting brackets 192A, 192B so as to transport the temporary brace 102 to a desired location. Depending on the structure and the ground surface, the user may select the appropriate bracket to couple to the adapter 110 for coupling to the structure and ground bracket 164 to the bolt coupler. Once in the desired location and with the appropriate brackets, the first and second cable struts 182A-182C, 184A-184C may then be extended and coupled together, thereby placing tension on the support cables 186, providing additional rigidity to the joint between the supports. The temporary brace 102 may then be positioned against a structure and the ground.

If the structure (i.e., wall) needs to be leveled vertically, the user may couple the hydraulic-powered adjuster 196 to the adjustment unit 154. Once attached, a telescopic handler, for example, may couple to the adjustment telehandler 196 to move the temporary brace 102 forward and backward so as to adjust the level of the structure. It may also adjust the overall height, which also aids in leveling, via the telescoping bracket 176. It will be appreciated that the temporary brace system 100 not only protects structures from wind and other natural elements prior to being secured but may also precisely adjust the plumb of a structure. Due to the strut assembly at the joint of the supports, the temporary support system 100 disclosed herein achieves heights not possible by the prior art. Additionally, due to the telescoping bracket, the height and/or positioning of the supports may be quickly and easily adjusted, which further overcomes shortcomings in the prior art.

It will also be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A temporary brace system comprising:

a temporary brace for supporting a structure, the temporary brace comprising:

a first support coupled longitudinally to a second support via a coupling bracket;

an adapter coupled to a top portion of the first support via an adapter base coupled to a top base portion, the adapter comprising a protrusion having a bracket aperture configured to receive an adapter bracket, the adapter bracket securable to the structure;

the top portion of the first support comprising a plurality of top cable coupling sites, each top cable coupling site receiving a first end of a respective top support cable;

a plurality of first cable struts extending radially from an end of the first support proximal to the coupling bracket, each first cable strut securing a second end of the respective top support cables;

the second support comprising a plurality of second cable struts extending radially from a first end proximal to the coupling bracket;

a plurality of bottom support cables, each bottom support cable extending between a respective second cable strut and a bottom cable coupling site;

a plurality of strut brackets, each strut bracket coupling a respective first cable strut to a respective second cable strut;

the second support comprising a bottom portion base configured to couple to an adjustment unit via an adjustment base;

a bolt coupler coupled at a first end to a bottom portion of the adjustment unit, the bolt coupler configured to couple to a ground bracket on a second end;

wherein the adjustment unit comprises a telescoping bracket, the telescoping bracket configured to slide longitudinally on the adjustment unit to thereby selectively lengthen or shorten the overall length of the temporary brace.

2. The temporary brace system of claim 1, wherein the ground bracket comprises a plurality of legs.

3. The temporary brace system of claim 1, further comprising hoisting brackets.

4. The temporary brace system of claim 1, further comprising a hydraulic-powered adjuster.

5. The temporary brace system of claim 1, wherein the telescoping bracket comprises one or more slidable channels and one or more securement means.

6. The temporary brace system of claim 5, wherein the securement means comprises bolts.

* * * * *